US005678332A

United States Patent [19]

Hawkins

[11] Patent Number: 5,678,332

[45] Date of Patent: Oct. 21, 1997

[54] CHANGEABLE AND RETRACTABLE IMPLEMENT FOR USE ON A BACK HOE AND METHOD

[76] Inventor: Bobby Leonard Hawkins, 2 Manley Rd., Travelers Rest, S.C. 29690

[21] Appl. No.: 667,948

[22] Filed: Jun. 24, 1996

[51] Int. Cl.[6] ..... E02F 3/76

[52] U.S. Cl. ..... 37/403; 37/406; 414/722

[58] Field of Search ..... 37/302, 404, 405, 37/406, 903, DIG. 12; 414/704, 722, 724, 740, 723

[56] References Cited

U.S. PATENT DOCUMENTS

| | | | |
|---|---|---|---|
| 4,375,345 | 3/1983 | Hanson | 37/403 X |
| 4,407,626 | 10/1983 | Bruckner | 37/406 X |
| 4,466,494 | 8/1984 | Hanson | 37/403 X |
| 4,803,788 | 2/1989 | Sorenson | 37/903 X |
| 4,804,309 | 2/1989 | Risch | 37/403 X |
| 4,845,867 | 7/1989 | Albrecht | 37/406 |
| 4,910,891 | 3/1990 | Martin et al. | 37/903 X |
| 4,932,832 | 6/1990 | McCasland et al. | 414/732 X |
| 5,553,408 | 9/1996 | Townsend | 37/406 |

*Primary Examiner*—Terry Lee Melius
*Assistant Examiner*—Robert Pezzuto
*Attorney, Agent, or Firm*—Ralph Bailey

[57] ABSTRACT

An attachment for use on an articulated boom of a back hoe has an elongated frame (A) for attachment on the boom opposite the bucket carrying an arm (B) having an elongated member receiving and positioning an elongated implement (C) opposite the open side of the bucket during a complete sequence of operation of the boom and bucket. A (D) removably secures the elongated implement on the implement receiving and positioning member for serving as a backup for the bucket gripping an object between the bucket and the implement. Thus an implement may be removably positioned in relation to the bucket of a back hoe for gripping an object therebetween for movement by the boom and for changing one implement for another upon the implement receiving and positioning members. An offset member (E) extends upwardly from the base for aiding in retracting the arm and the implement carried thereby. The telescoping members (F) provide a rigid support for the arm when in use as well as collapsibility to aid in retracting the implement for converting the back hoe from load moving to excavating.

25 Claims, 6 Drawing Sheets

CHANGEABLE AND RETRACTABLE IMPLEMENT FOR USE ON A BACK HOE AND METHOD

BACKGROUND OF THE INVENTION

This invention relates to a method and an implement positioned opposite the hydraulically operated bucket for aiding in gripping and moving loads so as to greatly increase the usefulness and versatility of a back hoe.

While back hoes have multiple uses in performing excavating and load handling functions it has been found that the versatility of the back hoe may be enhanced through the use of a fixed implement carried in opposition to the open side of the bucket to serve as a gripping device.

Even though it is recognized that substantial advantages may be achieved through the use of such an implement, disadvantages due to the structure contemplated by the prior art have discouraged the widespread use of such clamping devices with the hydraulically operated bucket of the back hoe. A fixed implement has been supplied by D & E Manufacturing of Moncks Corner, S.C. which comprises an implement attachable on one end to the dipper arm of the boom utilizing a rigid brace extending from an outer end of the arm to the boom at an attachment point above that of the implement. Several problems arise making the use of such an implement of limited practicality despite the many advantages achieved thereby. Disadvantages stem from the fact that it is difficult to change implements so as to substitute another style of implement for the standard fixed jaw which may have transverse teeth and curve downwardly at the end toward the digging edge of the bucket. Moreover, it is often desirable, when a load handling operation has been completed, to change over to an excavating mode. When this happens it is necessary with such prior art devices that the entire implement and support structure be removed from the dipper arm in order to get the implement out of the way so as not to interfere with the action of the bucket.

Other efforts to utilize an implement for gripping on a back hoe include the provision of a hydraulically operated clamping arm having a claw-like movement such as illustrated in U.S. Pat. No. 4,375,345. The repeated gripping action by the clamping arm together with the hydraulic operating mechanism complicate the structure and while the implement is retractable no provision is made for ready replacement of one style of implement with another which may be designed to be more useful with a specialized moving operation. The prior art is further illustrated by the following U.S. Pat. Nos. 2,042,196, 2,912,774, 3,807,589, 4,087,010, 4,327,509, 4,466,494, 4,804,309, 4,820,112, 5,111,602 and 5,472,308.

SUMMARY OF THE INVENTION

Accordingly it is an important object of the invention to provide an implement attachment apparatus for enhancing the usefulness of a stationary clamping implement for use in opposed relation to the open side of the hydraulically operated bucket of a back hoe.

Another important object of the invention is to provide an attachment for an implement for use of a back hoe in opposition to the hydraulically operated bucket on the dipper arm which will provide for ready changeability of implements having specialized designs for specific loading functions.

Another very important object of the invention is the provision of an attachment for an implement operating in opposition and in conjunction with the open side of a hydraulic bucket of a back hoe wherein the implement is readily retractable for temporary storage out of the way of an excavating function when the back hoe has been changed from moving to excavating.

It has been found that a versatile implement attachment apparatus may be provided utilizing an elongated frame affixed as by welding along a lower end of a dipper arm of a back hoe extending from a location adjacent the bucket upwardly for a sufficient distance to provide a support structure for a fixed outwardly extending arm carried adjacent a lower end of the frame providing an implement receiving and positioning member at its free end. Suitable fastening means are provided for removably installing a jaw on the implement receiving and positioning end of the arm which thereby provides easy changeability and longitudinally adjustable positioning for accommodating a variety of implements.

Furthermore, it has been found that a structure comprising members which are releasable for slidable movement with respect to each other, such as telescoping members, may be utilized to impart collapsibility to the implement attachment apparatus to make it retractable for placement out of the way for conversion of the back hoe from a load moving function to an excavating function. It is important that the members be securable together to present a substantially rigid support and that the assembly of members be connected on one end to a bracket carrying the outwardly extending arm for receiving the implement while the other end is connected to a frame which is fixed to the boom. Retractability of the implement for temporary storage during an excavating project is facilitated by providing the bracket which carries the outwardly extending arm with a base member connected to the telescoping members on one end while the other end of the bracket carries an offset arm pivotally connected to the frame to facilitate collapsibility of the telescoping assembly for storage adjacent the frame permitting the outwardly extending arm and implement carried thereby to be raised to a position in substantial alignment with the boom so as to be out of the way of the bucket during digging.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 6 is a perspective view illustrating a bucket and implement assembly wherein the implement has an inwardly curved outer end to facilitate moving of long loads such as railroad ties and the like;

FIG. 7 is a perspective view illustrating the operating mechanism for positioning the articulated boom and a form of implement suitable for gripping concrete conduits and the like;

DESCRIPTION OF A PREFERRED EMBODIMENT

A changeable and retractable attachment for use on an articulated boom of a back hoe having a hydraulically operated bucket carried for pivotal movement on a free end of the boom includes an elongated frame A for attachment in fixed relation in longitudinal alignment on the dipper arm of a boom adjacent the bucket. An arm B extending outwardly at approximately a right angle to the dipper arm is carried on one end by the elongated frame adjacent the bucket. The arm has an elongated implement receiving and positioning member carried on a free end thereof opposite an open side of the bucket. An elongated implement C is provided for reception upon the implement receiving and positioning member at a fixed angle opposite the open side of the bucket during a complete sequence of operation of the boom and bucket. Fastening means D removably secure the elongated implement on the implement receiving and positioning member for serving as a backup for the bucket gripping an object between the bucket and the implement. Thus, an implement may be removably positioned in relation to the bucket of a back hoe for gripping an object therebetween for movement by the boom and for changing one implement for another upon the implement receiving and positioning member. A mounting bracket has an elongated base and an offset member E extending upwardly from the base for pivotal connection to the frame. Telescoping members F are pivotally connected on one end to the base member and on the other end to the frame for forming, together with the arm and frame, a rigid retractable support for the implement.

Figure 6:
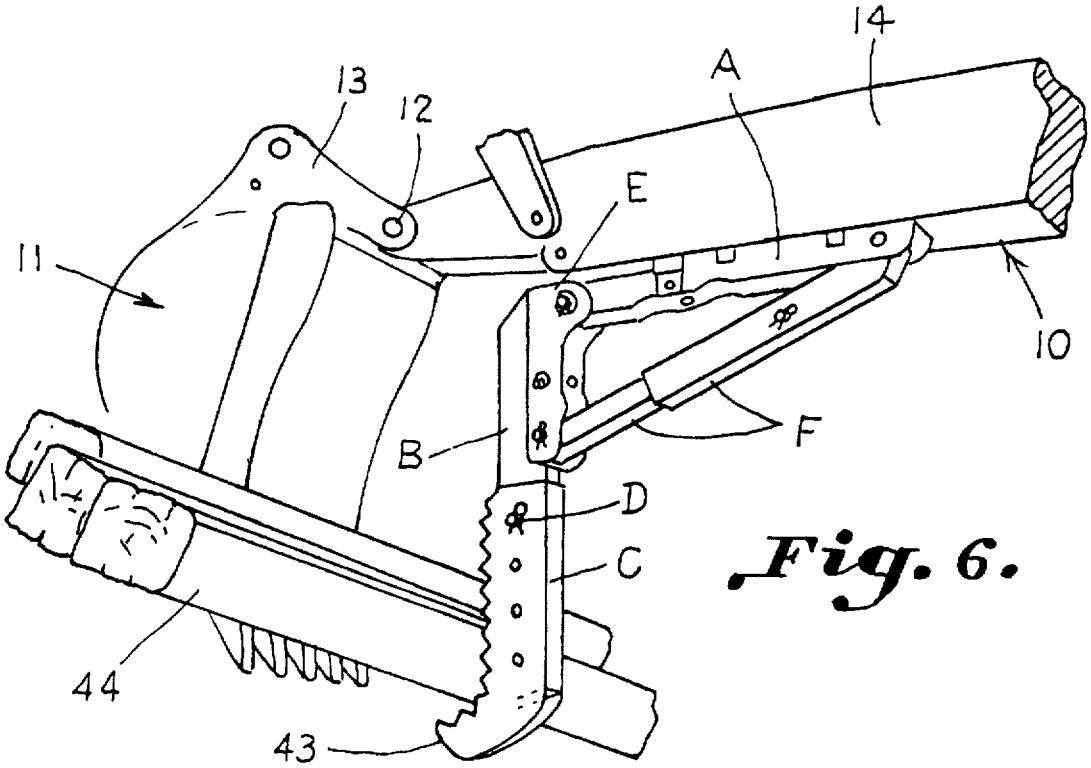
Figure 7:
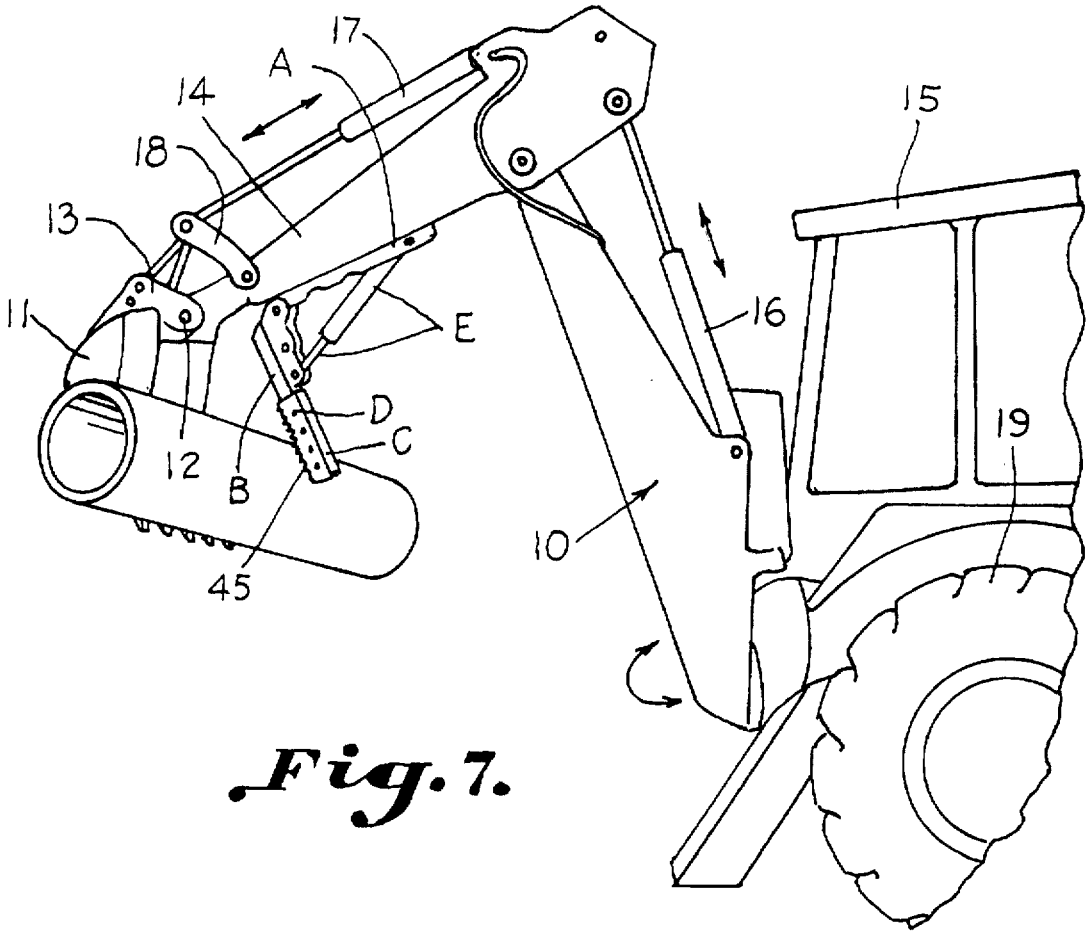

Referring more particularly to FIGS. 1, 2 and 6–8 an articulated boom broadly designated at 10 carries a hydraulically operated bucket broadly designated at 11. The bucket is pivotally mounted as at 12 on the free end of the boom. The bucket has a bracket 13 for securement at the pivot point 12 at the free end of the dipper arm 14 of the articulated boom 10. The boom 10 is best illustrated in FIG. 7 as being mounted on the frame of the back hoe beneath the cab 15 for movement in a horizontal plane as indicated by the arrow. A hydraulic cylinder 16 is provided for raising and lowering the dipper arm 14 whereas the cylinder 17 pivots the hydraulic bucket 11 up and down about the pivot point 12 through suitable linkage 18. In FIG. 7 the cab 15 is illustrated as being supported above the front wheels 19 and the frame of the back hoe is stabilized by four spaced stabilizing members (not shown) which are each forced downwardly and outwardly as illustrated by the cylinder 20.

Figure 1:
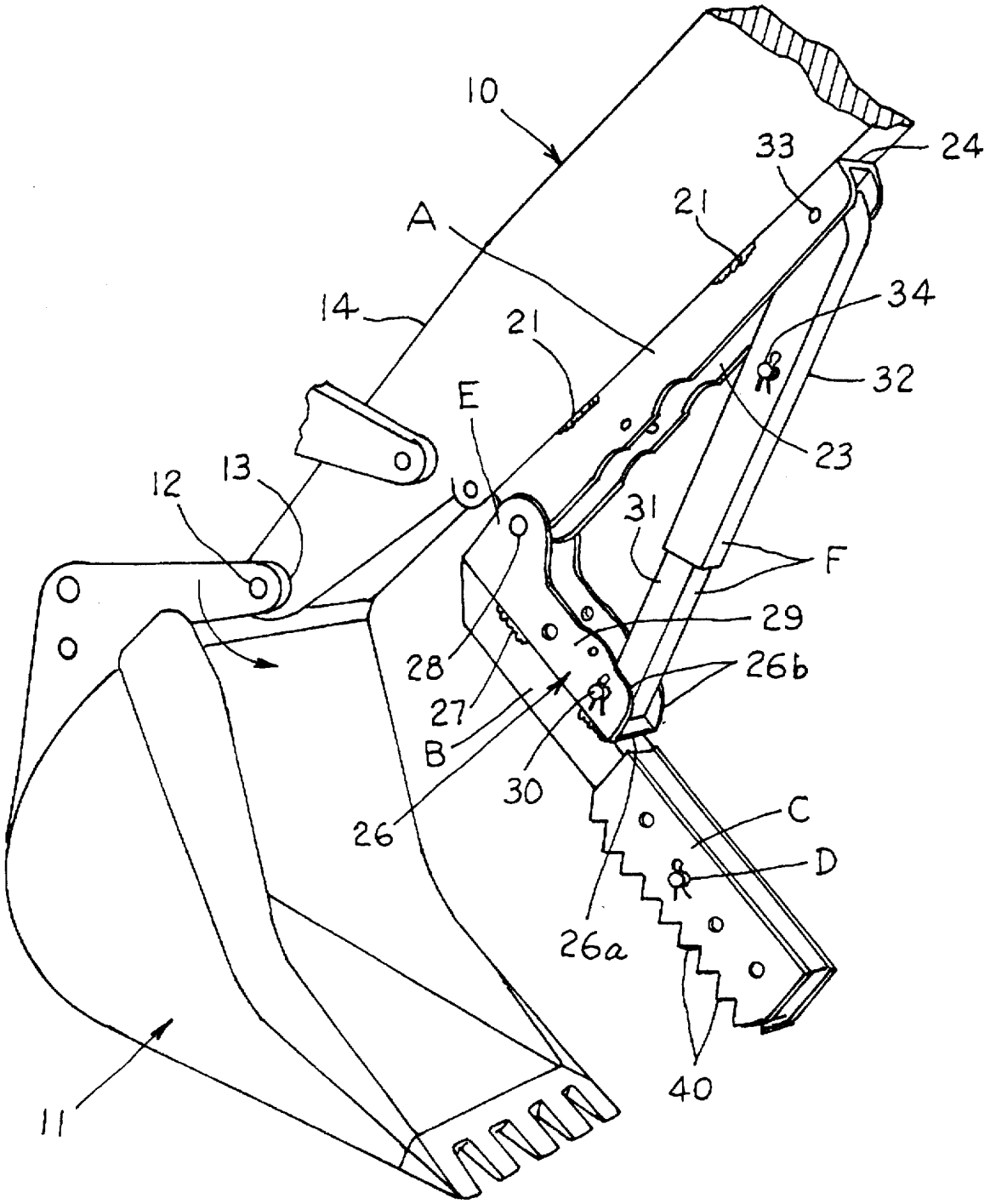
FIG. 1 is a perspective view illustrating the mounting of an implement attachment apparatus constructed in accordance with the invention with the implement in operating position in opposed relation to the hydraulically operated bucket carried at the free end of the dipper arm of the articulated boom of a back hoe.
Figure 2:
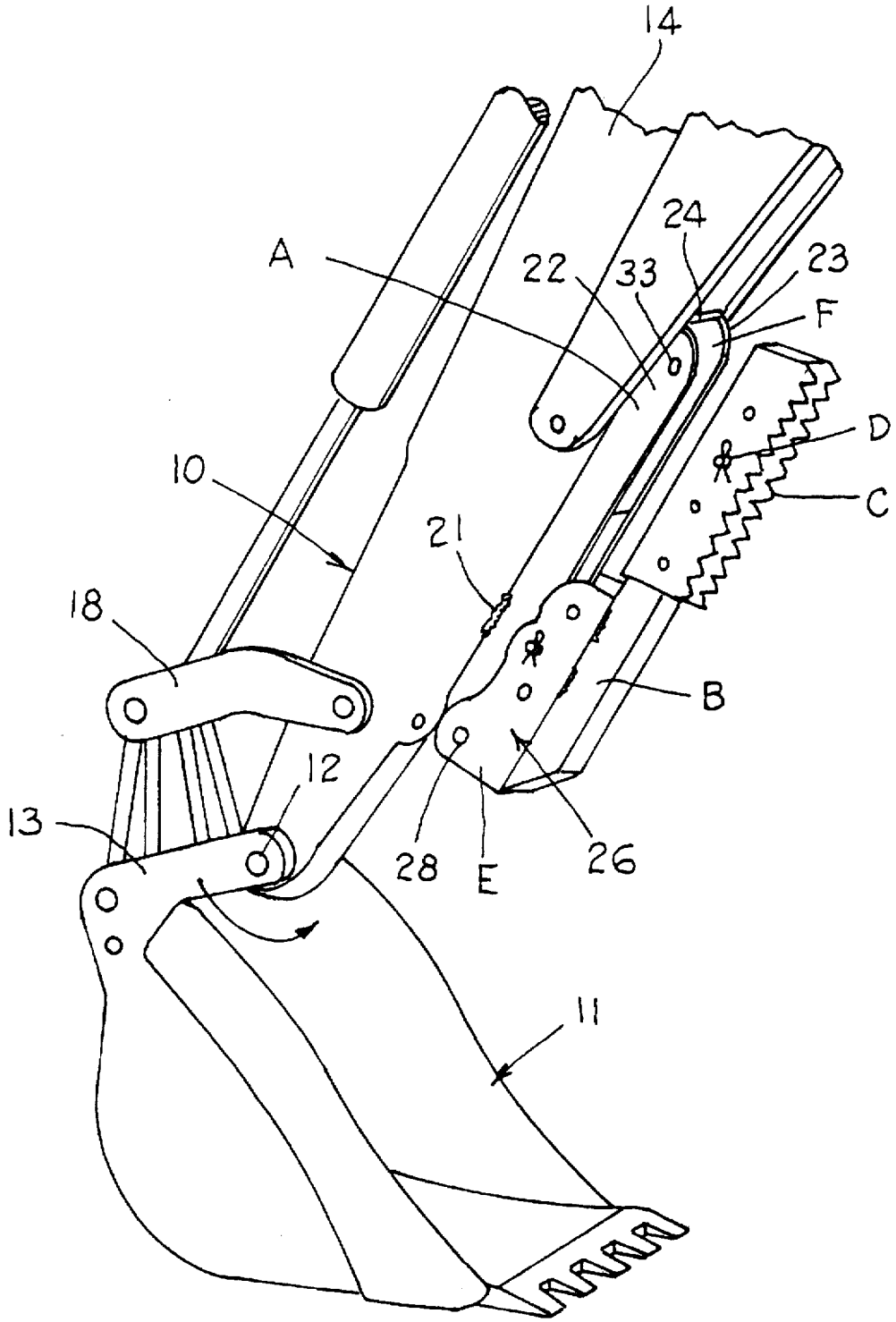
FIG. 2 is a perspective view showing the implement and illustrates associated supporting apparatus in retracted position to facilitate excavation utilizing the hydraulically operated bucket.

Referring more particularly to FIGS. 1 and 2, the elongated frame A is illustrated for attachment in longitudinal alignment on the dipper arm 14 of the boom adjacent the bucket 11 as by welding as at 21. The frame A includes a pair of outwardly extending longitudinal legs 22 and 23 which are bridged by a web member 24 which extends closely adjacent the boom and in contact with a lower surface thereof.

The arm B is illustrated as receiving an elongated implement C together with suitable fastening means D for adjusting the longitudinal positioning of the implement on a free end of the arm which provides an implement receiving and positioning member 25. The arm B is carried as by welding on a bracket broadly designated as at 26 (FIG. 1) for attaching the arm B as by welding at 27. The bracket 26 has a base **26*a* and a pair of upstanding arms 26*b*. The arms 26*b* adjacent the frame A form an offset member E on each side of the frame A for pivotal attachment thereto as at 28. The bracket 26 extends longitudinally along the arm B forming a base portion 29 for removable pivotal attachment at a remote and as at 30 to the telescoping members F. The telescoping members F include a lower member 31 receiving within an upper telescoping member 32. The upper member has pivotal connection as at 33** with the frame A forming a rigid triangular support for the arm B and the implement carried thereby.

FIG. 2 illustrates the components of the assembly in retracted position wherein a fastener pin 34 (FIG. 1) which normally holds the telescoping members in rigid relation against longitudinal movement is removed to permit release of the lower member 31 from its pivotal connection at 30. The telescoping members F are then partially collapsed so as to be received between the outwardly extending legs 22 and 23 of the frame A as illustrated in FIG. 2. The retracted position is facilitated through the offset member E at each end of the bracket 26 which encompasses the sides 22 and 23 of the frame A to permit the collapsible member F to be stored between the legs 22 and 23 as well as positioning of the outwardly extending arm B and the implement C closely adjacent and in substantial alignment with the dipper arm 14 of the boom so as to facilitate excavation freely utilizing the bucket 11 without obstruction.

Figure 3:
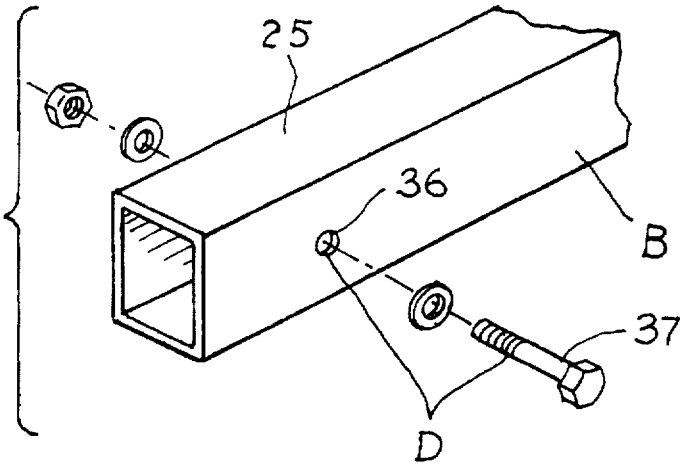
FIG. 3 is a right perspective view illustrating an implement receiving and positioning member at an outer end of an outwardly extending arm which is provided with fastening means for securing a selected implement of a desired configuration so as to be readily removable for reception of an implement of another construction.
Figure 4:
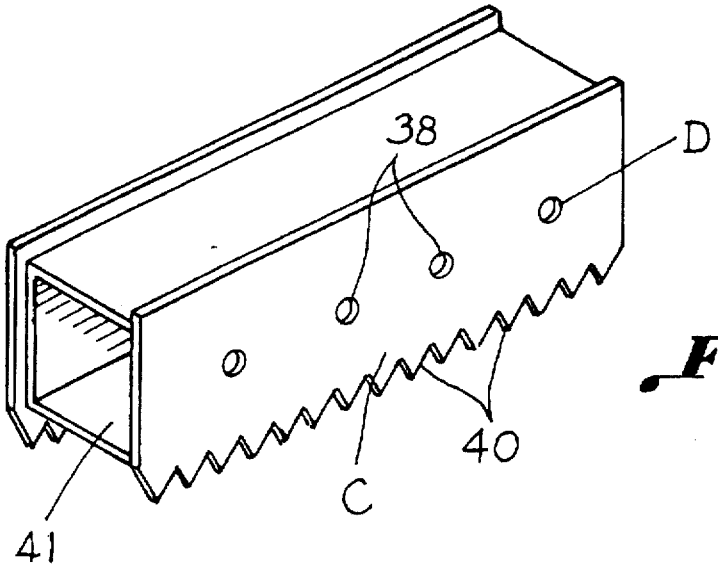
FIG. 4 is a perspective view similar to FIG. 3 illustrating an implement carried for reception upon the implement positioning and receiving member of FIG. 3 wherein a sleeve carries an elongated jaw including transverse teeth with longitudinally spaced aligned openings for receiving fastening means including a shank extending through transversely aligned openings selected to provide a desired adjustable positioning of the jaw upon the implement receiving and positioning member.

FIG. 3 illustrates the elongated rectangular implement receiving and positioning member 25 at the outer end of the arm B. At least one opening 36 extends transversely through the implement receiving portion 25 for receiving the shank 37 of a fastening member which passes through a selected longitudinally spaced opening 38 in the opposed sides 39 of the implement C. FIG. 4 illustrates the implement as having transversely disposed teeth 40 carried on each side of a rectangular sleeve 41.

Figure 5:
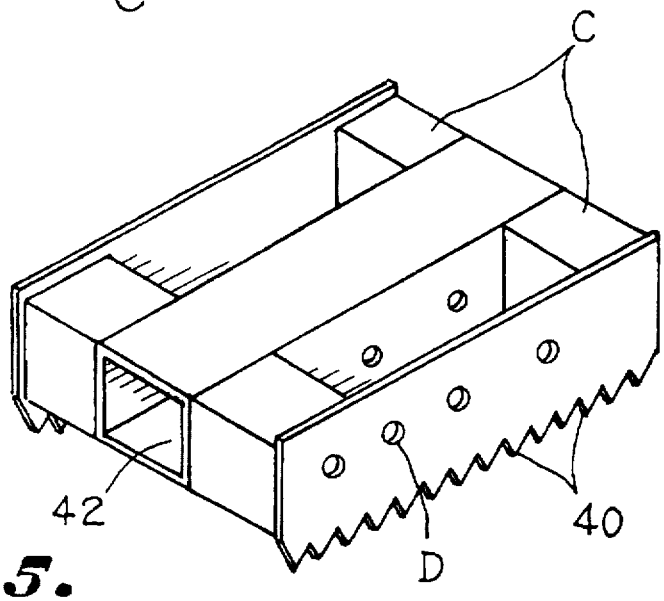
FIG. 5 is a perspective view similar to FIG. 4 illustrating a modified form of implement wherein a centrally disposed longitudinally aligned sleeve carries a pair of jaw members such as illustrated in FIG. 4 on each side to provide a wide gripping member as for example to facilitate the handling of a load having substantial girth such as a stump or a boulder.

FIG. 5 illustrates a modified form of the implement wherein an intermediate rectangular sleeve 42 carries an implement presenting teeth 40 on each side thereof as for handling wide loads such as stumps (not shown). FIG. 6 illustrates a modified form of implement having inwardly curved ends as at 43 for accommodating long loads such as railroad ties 44 whereas FIG. 7 illustrates the use of an implement 45 for handling elongated curved loads such as cement pipes 46.

Figure 8:
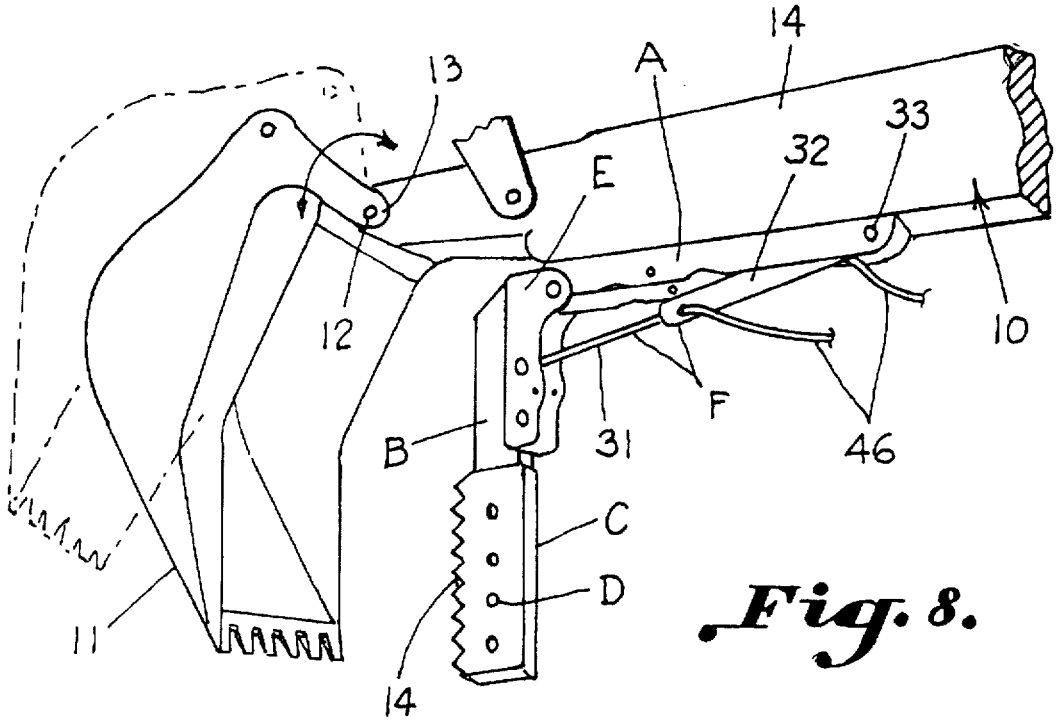
FIG. 8 is a perspective view illustrating a modified form of the invention utilizing a hydraulic cylinder acting as a telescoping member offering substantially rigid support for the implement arm during a moving operation.

FIG. 8 illustrates a modified form of rigid arm F in the form of a hydraulic cylinder 32 provided with fluid utilizing the lines 46 from a source of pressurized fluid (not shown) on the back hoe. While there may be some cushioning effect provided by the hydraulic cylinder and the piston rod 31 extending therefrom, the telescoping arm provided thereby is substantially rigid for the purposes of supporting the arm B.

Figure 9:
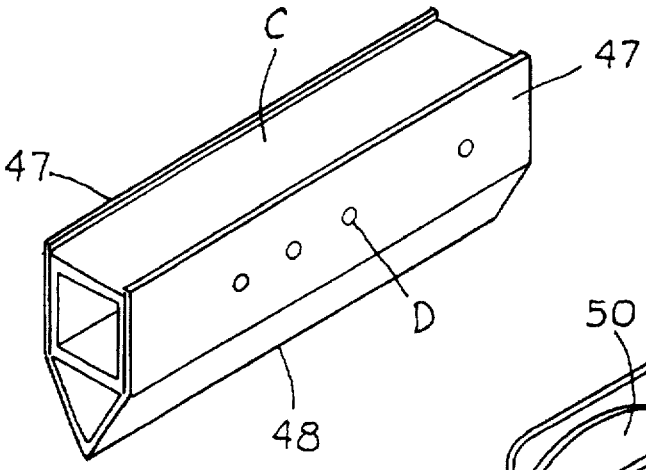
FIG. 9 is a perspective view illustrating a modified implement useful as a wedge for splitting wood longways.
Figure 10:
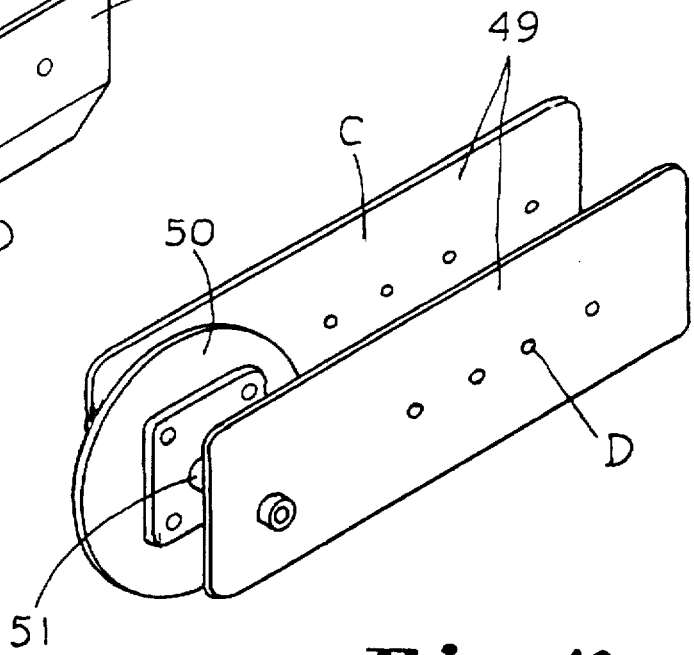
FIG. 10 is a perspective view illustrating another modified implement useful for edging an asphalt pavement and the like including side support members for mounting the implement on the fixed arm with a cutter wheel on an opposite end.

FIG. 9 illustrates a wedge-shaped implement having sides 47 which together with the tubular sleeve 41 form a support structure for attachment of the implement to the arm B. The sides taper inwardly forming a wedge 47 for splitting wood and the like or for gripping a load of special configuration. FIG. 10 illustrates yet another modified form of implement wherein the upright opposed sides 49 perform the attaching function of a sleeve providing transversely aligned openings acting as a part of the fastening means D. A cutter wheel 50 rotatably is carried on the shaft 51 for serving as an edger.

Figure 12:
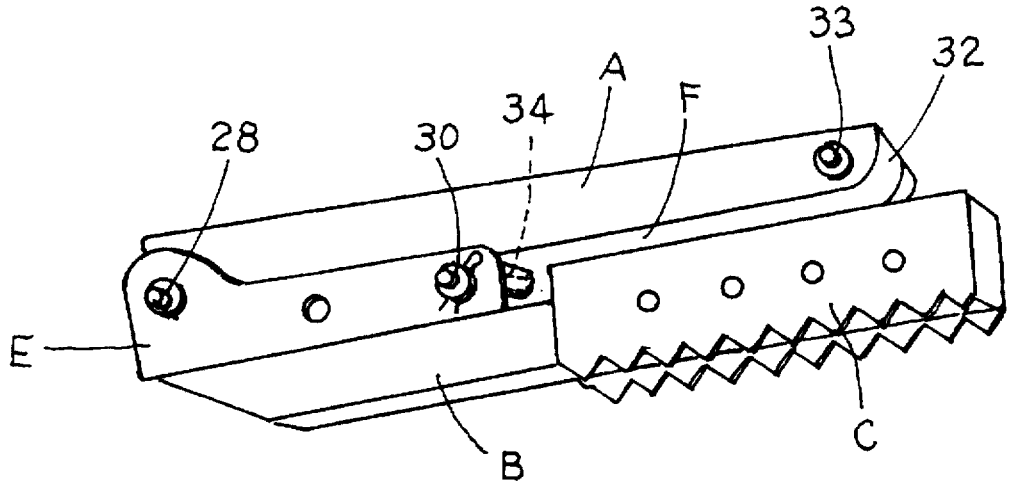
FIG. 12 is a perspective view illustrating the parts in retracted position with the placement of one of the pins in a bracket for retaining the assembly in retracted position.
Figure 11:
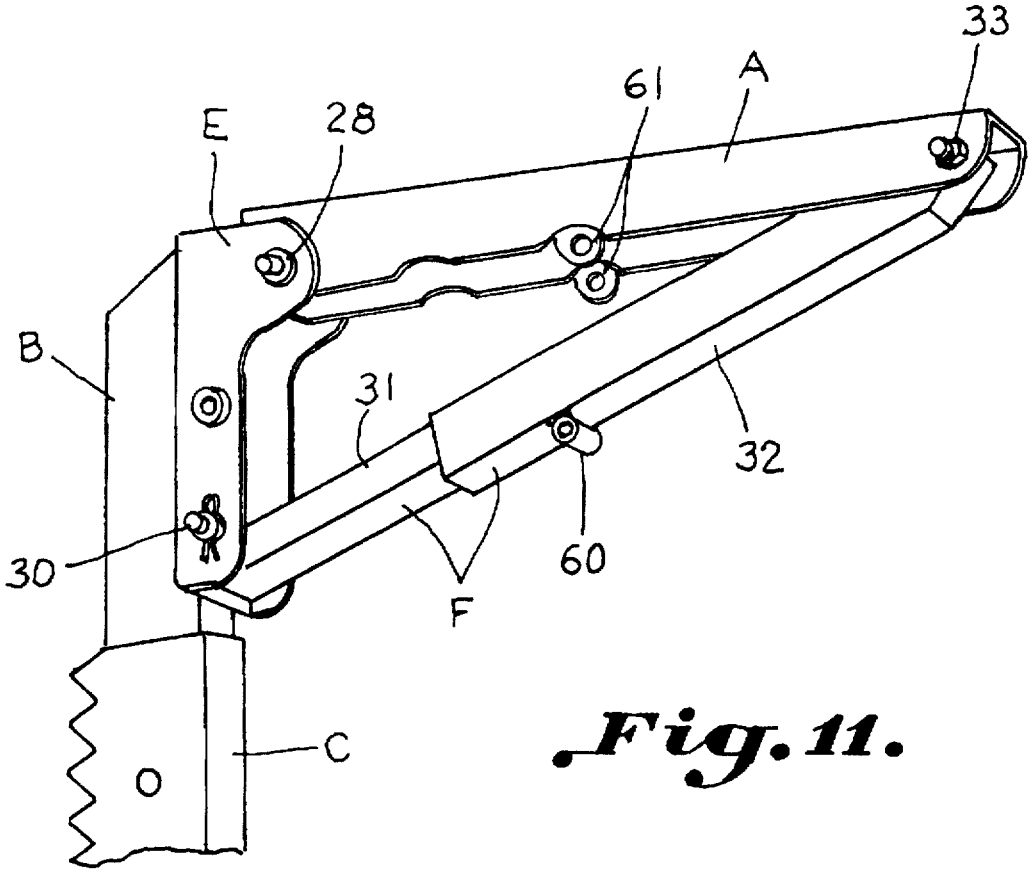
FIG. 11 is a perspective view illustrating the addition of a holder such as a loop for holding one of the pivot pins when removed for positioning the parts of the attachment assembly in retracted position.

FIG. 11 illustrates the addition of a retaining member in the form of a loop 60 suitably secured on an outer surface of the telescoping member 32. In addition, a pair of opposed brackets 61 have been added to an intermediate portion of the frame A for retaining the assembly in retracted position. It will be observed in FIG. 12 that the pivot pin 30 has been placed in the bracket 61 to retain the telescoping members F within the frame A and that the pin 34 has been removed from its position fixing the telescoping sections 31 and 32 and may be inserted and retained in the loop 60. Thus, when the pins are thus removed for retracting the implement to the position shown in FIG. 12 they each are retained for subsequent use in fixing the implement in operating position.

While a preferred embodiment of the invention has been described using specific terms, such description is for illustrative purposes only, and it is to be understood that changes and variations may be made without departing from the spirit or scope of the following claims.

What is claimed is:

1. A changeable attachment for use on an articulated boom of an excavator having a hydraulically operated bucket carried for pivotal movement on a free end of the boom comprising:

an elongated frame for attachment in fixed relation in longitudinal alignment on said boom adjacent the bucket;

an arm fixedly positionable on one end on said elongated frame adjacent to said bucket;

an elongated implement receiving and positioning member carried on a free end of said arm opposite an open side of the bucket;

an elongated implement slidably receivable in fixed relation upon a free end of said implement receiving and positioning member in alignment therewith for disposition at a fixed angle opposite the open side of said bucket during a complete sequence of operations of the boom and bucket; and fastening means removably securing said elongated implement on said implement receiving and positioning member for serving as a backup for the bucket gripping an object between the bucket and the implement;

whereby an implement is removably positioned on a free end of said elongated implement receiving and positioning member in opposed relation to the bucket of the excavator for gripping and moving an object therebetween for movement by said boom and being changeable for another implement upon the implement receiving and positioning member.

2. The attachment set forth in claim 1 including means pivotally securing said arm adjacent one end on an adjacent end of said elongated frame.

3. The attachment set forth in claim 2 wherein said means pivotally securing said arm includes a mounting bracket, said bracket having an elongated base fixed in alignment on an upper surface of said arm, and an offset member extending upwardly from said base for pivotal connection to said adjacent end of said frame.

4. The attachment set forth in claim 1 wherein said fastening means include a plurality of longitudinally spaced transverse openings aligned along said elongated implement and said elongated implement receiving said fastening member extending transversely therethrough positioning said elongated implement in opposed relation to said bucket for griping objects therebetween.

5. The attachment set forth in claim 3 including telescoping members pivotally connected on one end to said elongated base member opposite said offset member and on the other end to a remote end of said elongated frame; and fastening means rigidly securing said telescoping members against sliding with respect to one another forming, together with said arm and elongated frame, a rigid triangular support for said implement.

6. The attachment set forth in claim 5 wherein said elongated frame includes opposed outwardly extending legs receiving said telescoping members therebetween when disconnected from said elongated base member and collapsed sufficiently for reception between said pivotal connection with the remote end of said elongated frame and the pivotal connection of said offset member.

7. The attachment set forth in claim 3 including a hydraulic cylinder pivotally connected on one end to said frame remote from said arm and having a piston rod extending from the other end for connection to said offset member.

8. The attachment set forth in claim 4 wherein said implement receiving and positioning member has a generally rectangular cross-section; and wherein said implement includes a sleeve having an opening of generally rectangular cross-section for reception upon said member.

9. The attachment set forth in claim 8 wherein said implement includes a jaw facing downwardly toward said bucket.

10. The attachment set forth in claim 9 wherein said jaw includes a plurality of transverse longitudinally spaced teeth.

11. The attachment set forth in claim 10 wherein said jaw has an outwardly curving end remote from said implement positioning and receiving member.

12. The attachment set forth in claim 10 wherein said sleeve is carried intermediate a pair of aligned jaw members having said teeth thereon.

13. The attachment set forth in claim 9 wherein said implement is wedge shaped tapering downwardly and inwardly.

14. The attachment set forth in claim 9 including an implement, a cutting wheel carried for rotation at a lower end thereof.

15. A retractable attachment for use on an articulated boom of an excavator having a hydraulically operated bucket carried for pivotal movement on a free end of the boom comprising:

an elongated frame for attachment in fixed relation in longitudinal alignment on said boom adjacent the bucket;

an elongated implement;

a mounting bracket including an elongated base carrying said elongated implement in alignment therewith, and having an offset member extending upwardly from said base for pivotal connection to an adjacent end of said frame;

slidable aligned members pivotally connected on one end to said elongated base member opposite said offset member and on the other end to a remote end of said frame;

means securing said aligned members against substantial sliding movement; and said elongated implement being carried on said frame at a fixed angle opposite the open side of said bucket during a complete sequence of operations of the boom and bucket;

whereby said slidable members are disconnected from said bracket and contained between said frame and said implement when said bracket is pivoted upwardly to a position adjacent said frame.

16. The retractable attachment set forth in claim 15 wherein said slidable members are telescoping members and said connecting means are fasteners having a shank rigidly connecting said telescoping members.

17. The retractable attachment set forth in claim 15 wherein said slidable aligned members are a hydraulic cylinder and piston rod, said rod being connected to said bracket.

18. The retractable attachment set forth in claim 15 including an elongated implement receiving and positioning member carried by said bracket; and a sleeve removably positionable on said elongated implement receiving and positioning member.

19. The retractable attachment set forth in claim 18 wherein fastening means including longitudinally spaced aligned transverse openings in said sleeve and said implement receiving and positioning member receive a shank member for adjustably positioning said implement.

20. The retractable attachment set forth in claim 15 including a bracket carried by said frame for receiving a pin utilized in making a pivotal connection when supporting the arm in fixed outwardly extending position for retaining said pin and maintaining the arm in retracted position.

21. The retractable attachment set forth in claim 20 including a holder for a second pin utilized in making a pivotal connection when supporting the arm in fixed outwardly extending position.

22. The method of removably attaching an implement for use on an articulated boom of an excavator having a hydraulically operated bucket carried for pivotal movement on a free end of the boom comprising the steps of:

securing an elongated frame in fixed relation in longitudinal alignment on said boom adjacent the bucket;

mounting an arm on one end on the elongated frame adjacent to the bucket;

providing an elongated implement receiving and positioning member carried on a free end of the arm opposite the open side of the bucket;

securing an elongated implement upon the implement receiving and positioning member at a fixed angle opposite the open side of said bucket during a complete sequence of operation of the boom and bucket; and slidably positioning and removably securing said elongated implement on a free end of said implement receiving and positioning member for serving as a backup for the bucket gripping an object between the bucket and the implement;

whereby an implement is removably positioned in relation to the bucket of an excavator for gripping and moving an object and is changeable for another implement upon said implement receiving and positioning member.

23. The method set forth in claim 22 including the step of pivoting said arm upwardly on said frame retracting said implement to a position adjacent said frame.

24. The method set forth in claim 23 including the step of providing a rigid telescopically mounted support for said arm.

25. The method of attaching an implement for use on an articulated boom of an excavator having a hydraulically operated bucket carried for pivotal movement on a free end of the boom comprising the steps of:

securing an elongated frame in fixed relation in longitudinal alignment on said boom adjacent the bucket;

mounting an implement on one end on the elongated frame opposite the bucket during a complete sequence of operations of the boom and bucket;

providing a rigid telescopically mounted support for said arm having a first pivotal connection adjacent said implement on one end and a second pivotal connection adjacent a remote end of said frame;

releasing said first pivotal connection and pivoting said rigid telescopically mounted support upwardly to retracted position adjacent to said frame; and pivoting said implement upwardly to a position adjacent said frame during subsequent operations of the boom and bucket;

whereby an implement is retractably positioned in relation to the bucket of an excavator for gripping and moving an object and movably positioned in retracted position out of the way of further operations of the boom and bucket.

* * * * *